United States Patent [19]

Lolachi et al.

[11] Patent Number: 4,540,397

[45] Date of Patent: Sep. 10, 1985

[54] CENTRIFUGAL APPARATUS

[75] Inventors: Houshang Lolachi, Rockville, Md.; Bernd Mathieu; Wolfram Weber, both of Spiesen-Elversberg, Fed. Rep. of Germany

[73] Assignee: Fresenius AG, Bad Homburg, Fed. Rep. of Germany

[21] Appl. No.: 553,297

[22] Filed: Nov. 18, 1983

[30] Foreign Application Priority Data

Nov. 18, 1982 [DE] Fed. Rep. of Germany ..... 3242541

[51] Int. Cl.[3] ..... B04B 9/08; B04B 11/00

[52] U.S. Cl. ..... 494/84; 494/18

[58] Field of Search ..... 494/18, 84, 17, 35, 494/43, 85; 210/360.1, DIG. 24

[56] References Cited

U.S. PATENT DOCUMENTS

| | | | |
|---|---|---|---|
| 4,113,173 | 9/1978 | Lolachi | 494/18 |
| 4,164,318 | 8/1979 | Boggs | 494/18 |
| 4,194,684 | 3/1980 | Boggs | 494/18 |
| 4,425,112 | 1/1984 | Ito | 494/18 |

*Primary Examiner*—Robert W. Jenkins

*Attorney, Agent, or Firm*—Cushman, Darby & Cushman

[57] ABSTRACT

A centrifugal apparatus, in particular a flow-through centrifugal apparatus for processing biological fluids in continuous fluid communication, has a flexible tube securely fixed to a rotatably processing chamber and a stationary terminal coaxially above said processing chamber, and being formed in a loop around the outer periphery of said processing chamber so as, in operation, to orbit said loop around said processing chamber at half the rotational speed thereof to avoid twisting or drilling of said tube. To guide said loop of tube in its orbital movement, a rotating frame is provided also rotating at half the speed of the processing chamber. The drive trains for said processing chamber and said rotating frame, respectively, each comprise an individual drive shaft each drivingly connected separate from the other to a drive motor. This avoids any necessity of reversal of rotational direction in the drive trains and allows for a compact and simple construction with a minimum of rotating masses.

17 Claims, 3 Drawing Figures

CENTRIFUGAL APPARATUS

BACKGROUND OF THE INVENTION

The invention refers to a centrifugal apparatus, and in particular, but not exclusively to a flow-through centrifugal apparatus in which materials are to be centrifuged while flowing through in continuous communication, for example for blood or plasma processing.

One problem with respect to centrifugal flow-through systems is to establish continuous fluid flow communication between a stationary feeding terminal and a discharged terminal at the revolving fluid processing chamber. The relative movement of the two terminals causes a twisting of the connecting tube. Therefore, in case of conventional flow-through centrifugal systems rotating seals or couplings are used for the connection at the terminals. The manufacturing of such rotating seals is expensive, and normally under the action of rotation they give off particulate matter from the seal material which may lead to leaking spots at the connecting terminals. Especially for processing blood, the use of rotating seals is problematical as defects and leaks can cause contamination of the ambience as well as of the blood to be processed. Furthermore, the fragile components of blood, particularly thrombocytes, can be damaged while passing through the high friction or turbulence caused by a rotating seal.

In order to solve these problems it is known from German Auslegeschrift No. 2,114,161 to establish connections between rotating and stationary parts in such a way that to avoid twisting or drilling the use of rotating seals or slip rings is not required. For this purpose the tube—or for centrifugal apparatusses not of the flow-through type, generally the cable—is led from the stationary terminal overlapping the rotating part in a loop which is revolved around the rotating part at half the angular velocity of the processing or separation chamber, and in the same direction. For establishing this system derived from the spinning-mill technology a stationary gear rim is mounted onto a stationary basic structure coaxially through which extends a shaft driven by a motor. On this shaft a hollow cylinder is mounted which rotates unison with the shaft, the cylinder having a gear wheel laterally offset with respect to the axis of rotation meshing with the stationary gear rim and riding on the stationary gear rim when the hollow cylinder is rotating. Further mounted at the hollow cylinder is a laterally offset auxiliary shaft also equipped with gears on top and bottom thereof, the lower gear meshing with the first gear wheel and being rotated thereby. The upper gear, keyed to the auxiliary shaft as well as the lower gear and rotating in unism therewith, transmits its rotating movement to a drive gear of a revolving chamber, i.e. the processing chamber in the case of a flow-through centrifugal apparatus, which is mounted coaxially to the shaft driven by the motor. The transmission ratio of the described gear arrangement is selected in such a way that the hollow cylinder moves with half the angular velocity and in the same direction as the processing chamber thus twisting or drilling of the connecting flexible tube or a cable is avoided. A disadvantage in the known arrangement is in general the use of toothed gears. Due to such gear arrangement the production of the centrifugal apparatus has to be effected with high precision, and, therefore, is complicated and expensive. In addition, gears need maintenance, e.g. have to be lubricated, and are relatively noisy in operation. A further disadvantage consists in obtaining the drive of the processing chamber from the revolving gear wheel riding on the stationary gear rim. Due to this, the direction of the gear rotation is opposed to that of the hollow cylinder. In order to obtain the required movement consistent with the direction of rotation of the hollow cylinder, an additional gear is necessary for nothing but the reversion of the direction of rotation, this also increasing the noise level, the maintenance frequency and expenditure, and the cost of production due to the necessity of high precision.

In order to reduce the noise of centrifugal apparatusses driven by toothed gears and to compensate production tolerances in the driving units, it is further known from German Offenlegungsschrift No. 2,612,988 to drivingly connect the individual shafts by means of drive belts. In principle, however, the basic construction as above described remains unchanged. Therefore, also here a stationary pulley is provided in succession to the motor drive unit, and to this pulley a drive belt is coupled which on the other hand is coupled to a laterally offset pulley revolving together with the hollow cylinder causing the movement of the fexible tube loop. The revolving movement of this pulley is, by having the drive belt coupled to the stationary pulley as center of revolution of the revolving pulley, transferred into a rotational movement of the latter pulley fitted to the hollow cylinder thus providing drive to the processing chamber. As in the case of the arrangement described before, also here the driving movement for the processing chamber is provided in opposite rotational direction than required, and has to be reversed into the required rotational direction by means of auxiliary shafts with auxiliary pulleys resulting in producing twice the angular velocity of the hollow cylinder in the required direction. The construction is generally complicated and expensive, and it can lead to fairly big and heavy rotating parts. In addition, the high centrifugal forces thus produced have to be controlled, which, due to the large loop of the connecting flexible tube, become greater and produce more stress also in the tube. For twisting or detwisting of the connecting tube its loop may be guided in eyelets or rings along the rotatable hollow cylinder. In case of larger tube loops, as required in the afore-mentioned systems because of the necessary units for reversing the rotational direction, the tubes are relatively heavily stressed at the terminals, in particular due to centrifugal forces and simultaneous friction. To eliminate this, it is further known from German Offenlegungsschrift No. 2,611,307 to firmly hold the loop on its outer side and to detwist it by means of a detwisting unit linked to the drive via a toothed belt. This construction is complicated and leads to a complicated and expensive arrangement of the centrifugal apparatus.

SUMMARY OF THE INVENTION

Therefore, it is a main object of the invention to provide a centrifugal apparatus of the kind defined in the opening portion of claim 1, which does not necessitate means for reversion of rotational direction, and which may have smaller rotating parts of a simpler construction thus reducing production costs.

According to the invention, a drive arrangement is proposed in which separate drives for the processing chamber and for the revolving guide assembly for guiding and revolving the cable or tube loop at half the angular velocity in the same direction as the processing chamber are arranged in parallel. Thus, there is provided a first drive shaft for driving the guide assembly, and a second drive shaft for driving the processing chamber, said first and second drive shafts both being drivingly connected to a driving shaft of a motor drive unit mounted on a stationary supporting frame. In case of such an arrangement, a stationary gear rim or a stationary pulley is eliminated on which succeeding rotating parts ride and are driven in orbital revolution, so that no counterrotation is produced which subsequently has to be reversed again.

Preferably, the first shaft is a hollow shaft for driving the loop guide assembly, coaxially through which the drive shaft for driving the processing chamber extends and is held rotatable independently of the hollow shaft.

The first shaft for driving the loop guide assembly and the drive shaft for driving the processing chamber may directly be driven by a motor driving shaft in the same direction as required, the speed ratio of 2:1 being preferably already here set by a corresponding selection of the transmission ratios. Thanks to the omission of means for a reversal of rotation, the entire construction of the centrifugal apparatus is much simpler and thus less expensive.

Another decisive advantage of the suggested arrangement resides in the fact that the size of the rotating parts around which the tube has to be guided and revolved, can be reduced. This leads to a reduced centrifugal and pulling force on the tube or cable. Additionally, the surfaces where the tube or cable and the rotating parts of the centrifugal apparatus contact each other can be kept small. This becomes particularly clear, if the processing chamber is located whithin a rotating frame of the loop guide assembly, and the flexible tube or cable may twist and detwist freely without having to overcome additional friction forces between the tube or cable and the loop guide assembly. This also contributes to a simpler and less expensive construction of the centrifugal apparatus and the disposable parts such as the processing chamber and its tube attachment that are used during a centrifugal process.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in connection with the accompanying drawings, in which:

DESCRIPTION OF PREFERRED EMBODIMENTS

Figure 1:
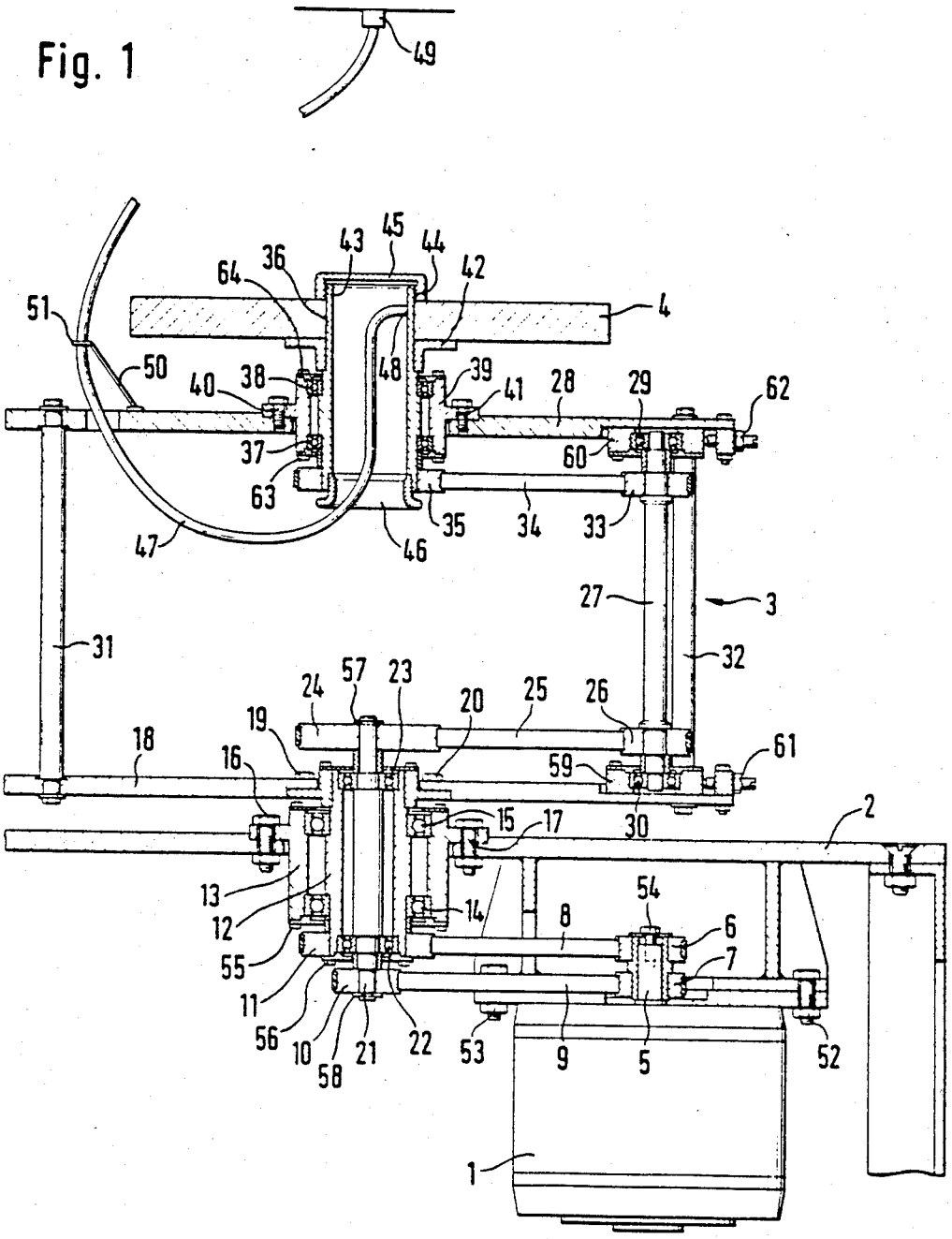
FIG. 1 shows a vertical cross-section of a first embodiment of a centrifugal apparatus of the invention.

FIG. 1 shows a first embodiment of a centrifugal apparatus comprising a drive motor 1 on a supporting structure 2, a rotating frame 3 rotatably mounted on the supporting structure 2, and a processing chamber assembly 4 rotatably mounted on rotating frame 3. The drive motor 1 has fitted on its vertical shaft 5 two pulleys 6 and 7 in axially spaced relationship from which drive belts 8 and 9 form a driving connection to further pulleys 10 and 11. Pulley 11 is keyed to a first or hollow shaft 12 at the lower end thereof, the shaft 12 being mounted and positioned in a bearing shell 13 by means of two bearings 14 and 15. The bearing shell 13 is removably fastened to the supporting structure 2 via screws 16 and 17. On the upper portion of the hollow shaft 12 a flange member is fitted to which a lower bearing plate 18 of the rotating frame 3 is removably fastened by means of screws 19 and 20.

When, in operation, the drive motor 1 is activated, the driving shaft 5 and consequently pulley 6 start rotating at a determined rotation of speed. Pulley 11 on the hollow shaft 12 has twice the diameter of pulley 6 so that, in view of the transmission by drive belt 8, the hollow shaft 12 rotates with half the rotational speed of drive motor 1. Due to the rotating frame 3 being held fixedly by the hollow shaft 12, rotating frame 3 consequently also rotates at half the rotational speed of drive motor 1.

Pulley 7 has the same diameter as pulley 10 which is keyed to a second drive shaft 21 for the processing chamber assembly 4. Second drive shaft 21 projects through hollow shaft 12 spaced by bearings 22 and 23. To the upper end of second drive shaft 21, projecting only slightly beyond the upper end of hollow shaft 12, the latter end being approximately aligned with the lower bearing plate 18, a further pulley 24 is fitted. The pulley 24 is coupled via a drive belt 25 to a pulley 26 which is fixed at the bottom side of a vertical auxiliary shaft 27. The auxiliary shaft 27 extends between the lower bearing plate 18 and an upper bearing plate 28 of rotating frame 3, and is mounted in bearings 29 and 30, the lower and upper bearing plates 18 and 28 being positioned in spaced apart relation by bracings 31 and 32. The auxiliary shaft 27 is laterally offset relative to the rotational axes of hollow shaft 12 and second drive shaft 21 into the, with respect to the center axis of the apparatus, radially exterior region of the lower and upper bearing plates 18 and 28. The rotating movement is thus laterally moved from the rotational axis in the center towards the side region of the rotating frame 3. The rotating movement is, by means of a pulley 33 mounted on the upper side of auxiliary shaft 27 and a drive belt 34 drivingly connecting pulley 33 to a pulley 35, returned to the central rotational axes of the rotating frame 3. The pulley 35 is fixed to the lower end of a vertical hollow shaft 36. Hollow shaft 36 is mounted by means of bearings 37 and 38 in a bearing shell 39 which is removably fastened to the upper bearing plate 28 by means of screws 40 and 41. To the outer periphery of the hollow shaft 36, above the upper bearing plate 28 and thus outside the space and compassed by rotating frame 3, there is secured a flange 42 onto which the ring-shaped processing chamber assembly 4 is mounted, the hollow shaft 36 with its upper end 43 projecting through a central recess of the processing chamber assembly 4. The upper end 43 of the hollow shaft 36 is threaded as at 44 to receive thereon a screw cap 45 to secure the position of the processing chamber assembly 4. On the bottom side of hollow shaft 36 there is inserted a funnel-shaped ring piece 46 with a flaring lower rim.

In operation, when the drive motor 1 is activated, driving shaft 5 of the drive motor 1 and consequently also pulley 7 are driven at a determined rotational speed. As pulleys 7 and 10 have equal diameters, the second drive shaft 21 is operated at the same rotational speed. Pulleys 24 and 35 have equal diameters, and pulleys 26 and 33 also have equal diameters, however, different from those of pulleys 24 and 35. Consequently, there is no change in transmission ratio between pulleys 24 and 35, but only a laterally offset arrangement of auxiliary shaft 27, so that a free space remains between pulley 24 and the funnel-shaped ring piece 46. Hollow shaft 36 and consequently the processing chamber assembly 4 are operated, therefore, at the same rotational speed as drive motor 1, and at twice the rotational speed of rotating frame 3.

A flexible tube 47 in which an inlet and outlet tubing or a whole bundle of such individual tubings may be contained for flow-through operation maintaining continuous liquid communication, and which may contain e.g. electrical cables or the like in other instances, is inserted from below into the hollow shaft 36 and fastened to the processing chamber assembly 4 by means of a terminal 48. Flexible tube 47 is bent upwards in a loop around the processing chamber assembly 4 to a stationary connection terminal 49. At the upper bearing plate 28 an upwardly inclined tube support member 50 is mounted which terminates in a ring 51 that can be opened by means of a spring lock and in which flexible tube 47 is inserted.

The centrifugal apparatus described so far in its essential parts and the functioning of the drive for rotating frame 3 and processing chamber assembly 4 serves the following purpose:

The medium to be centrifuged is transported via tube 47 from the stationary terminal 49, which may for example be located at a recipient, to processing chamber assembly 4 rotating with the rotational speed of drive motor 1. As mentioned above, rotating frame 3 is turned at half the rotational speed of processing chamber assembly 4 so that the loop of tube 47, which is held by rotating frame 3 via tube support member 50 is moved round processing chamber assembly 4 at half speed. As described initially, this has the effect known per se that tube 47 neither gets twisted nor drilled. Tube 47 can move freely in its longitudinal direction in ring 51.

An essential advantage of the embodiment of FIG. 1 consists in its simple construction and the possibility of an easy and fast access to all parts. Maintenance and replacement of parts can thus be carried out fast and easily.

By means of screws 52 and 53, drive motor 1 may be detached from the supporting structure 2 and replaced easily. For removing and possibly replacing drive belts 8 and 9, the upper pulley 6 on driving shaft 5 may be pulled off after unscrewing screw 54, whereby also the lower drive belt 9 becomes accessible and drive motor 1 can be taken out of the supporting structure 2 in downward direction.

Similarly, and without problems, the entire rotating frame 3 can be separated from supporting structure 2 by unscrewing screws 16 and 17. Further, the unit consisting of bearing shell 13, hollow shaft 12 and second drive shaft 21 may be dismantled without problems. The bearings 14 and 15 between the bearing shell 13 and the hollow shaft 12, and the bearings 22 and 23 between the hollow shaft 12 and the second drive shaft 21 are each held from their outer side by means of screws 55 and 56, after unscrewing of which bearings 14, 15, 22 and 23 as well as bearing shell 13, hollow shaft 12 and second drive shaft 21 may be separated from each other. Pulleys 10 and 24 are secured from their outer side by means of snap rings 57 and 58, e.g. in the form of Seeger circlip lock rings, and may be removed easily.

After unscrewing of screws 19 and 20, and removing pulley 24 and drive belt 25, rotating frame 3 with its lower bearing plate 18 can also be removed.

Also, auxiliary shaft 27 with bearings 29 and 30 and pulleys 26 and 33 can be easily dismantled and at the same time adjusted in position, e.g. in order to obtain a suitable drive belt tension. With this in mind, the bearings 29 and 30 of auxiliary shaft 27 are located in bearing stands 59 and 60 which are shiftable in direction of the drive belts 25 and 34 by means of setting devices 61 and 62 arranged at the outer end portions of lower and upper bearing plates 18 and 28, respectively. After unscrewing and removing of setting devices 61 and 62, the entire auxiliary shaft 27 may be removed, e.g. in order to replace drive belts 25 and 34.

Dismantling of the processing chamber assembly 4 or its supporting and driving elements can also be carried out easily. After unscrewing of screws 40 and 41, the entire unit connected to bearing shell 39 may be removed from the rotating frame 3. The bearings 37 and 38, by means of which hollow shaft 36 is mounted, may be taken out of bearing shell 39 after unscrewing screws 63 and 64, whereby also the hollow shaft 36 may be pulled out of bearing shell 39. Altogether, maintenance, i.e. cleaning and repair works, may be easily and quickly carried out with the construction described above.

Figure 2:
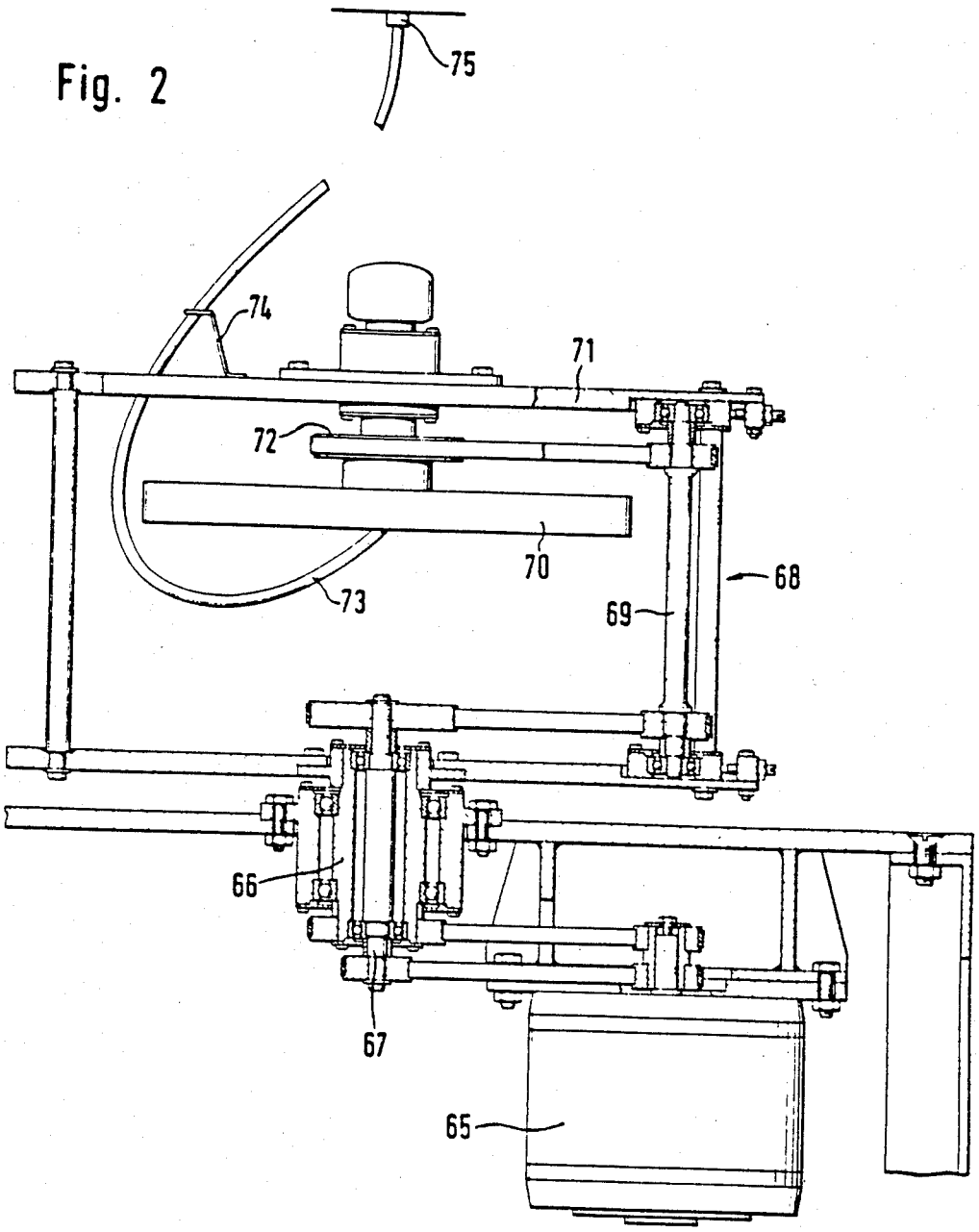
FIG. 2 shows a vertical cross-section of a second embodiment of a centrifugal apparatus of the invention.

FIG. 2 shows another embodiment of a centrifugal apparatus which in its essential parts is identical to the embodiment described above with respect to FIG. 1. These identical parts comprise a drive motor 65 having driving connection to a hollow or first drive shaft 66 and a second drive shaft 67 for driving a processing chamber assembly 70, the hollow shaft 66 driving a rotating frame 68, and the second drive shaft 67 driving, via an auxiliary shaft 69, the processing chamber assembly 70 at twice the rotational speed of rotating frame 68. Also in this embodiment, the rotating frame 68 has a lower bearing plate and an upper bearing plate at 71. However, in this embodiment, the processing chamber assembly 70 is not located above the upper bearing plate 71, but below a pulley 72 within the space and compassed by rotating frame 68. A tube 73 is, also in this embodiment, introduced into the processing chamber assembly 70 from below, and is formed as a loop around the processing chamber assembly 70 by means of a tupe support member 74; also, tube 73 has a stationary terminal 75 above the centrifugal apparatus in axial direction of the processing chamber assembly 70.

The arrangement shown here has the advantage that the rotating masses are more concentrated as compared to the first embodiment and thus can be controlled more easily with regard to vibrations and unbalances. Moreover, the entire arrangement becomes more compact because of the location of the processing chamber assembly 70 within the rotating frame 68.

Figure 3:
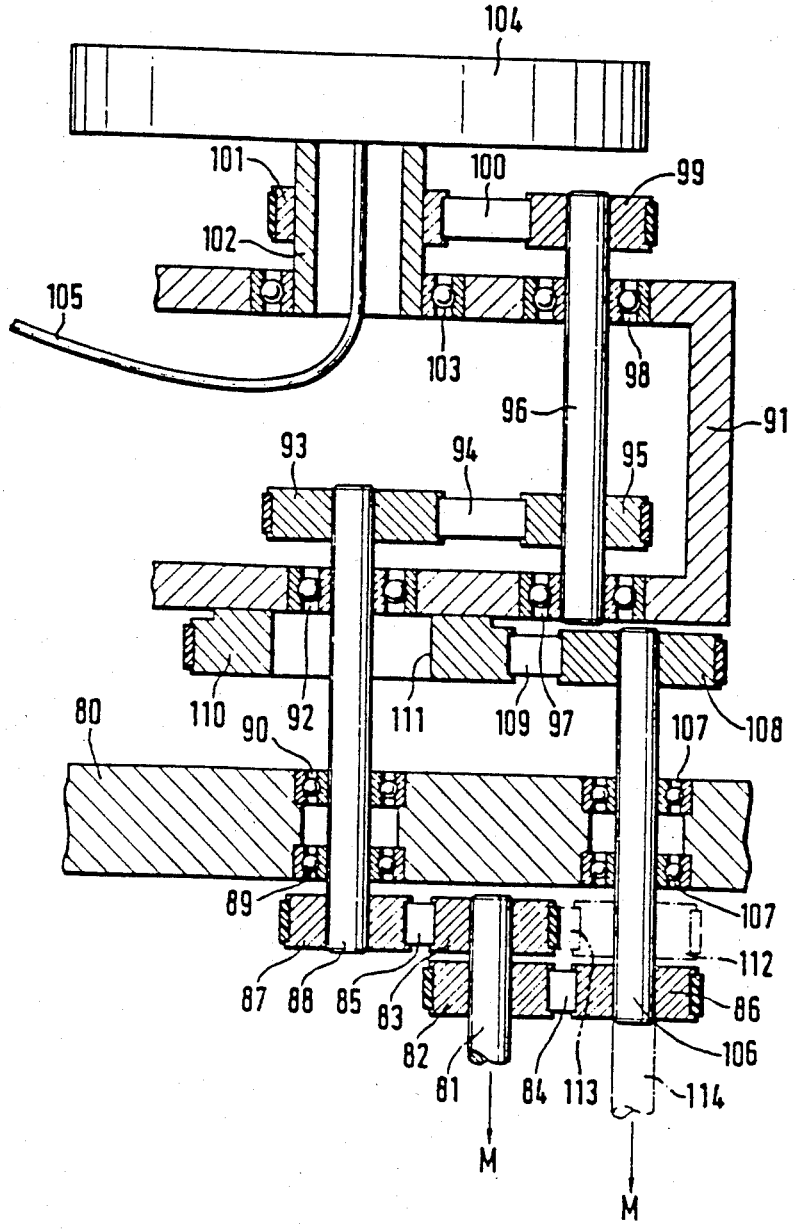
FIG. 3 shows a vertical cross-section of a third embodiment of a centrifugal apparatus of the invention.

In FIG. 3, a further embodiment of the invention is shown, which contrary to the embodiments of FIGS. 1 and 2 does not have a coaxial mounting of the first and second drive shafts, both drive shafts are rather arranged separately from each other and penetrate—as discussed in more detail hereinafter—through a supporting structure 80 at a distance from each other. Keyed to a driving shaft 81 of the drive motor schematically indicated by an arrow M, are two pulleys 82 and 83 axially spaced apart, to which pulleys 82 and 83 drive belts 84 and 85 drivingly connect further pulleys 86 and 87 respectively.

Pulley 87 is arranged at the lower end of a second drive shaft 88 for driving of a processing chamber assembly 104, which is rotatably mounted in the support structure 80 by means of bearings 89 and 90.

The second drive shaft 88 furthermore extends through the lower bearing plate of a rotating frame 91 where it is rotatably mounted by means of a bearing 92. To the second drive shaft 88, at the upper end thereof, there is fitted another pulley 93 which is drivingly connected to a pulley 95 via a drive belt 94, which pulley 95 is keyed to an auxiliary shaft 96. The auxiliary shaft 96 is, with the lbwer end thereof, rotatably mounted by bearing 97 in rotating frame 91, and, with its upper end, penetrates through the upper bearing wall of the rotating frame 91 and projects therefrom, being mounted by a further bearing 98. To the auxiliary shaft 96 is, at the upper end thereof, fitted a pulley 99, which is drivingly connected to pulley 101 via a drive belt 100, pulley 101 being keyed to a hollow shaft 102. The axis of the hollow shaft 102 is in alignment with the axis of rotation of second drive shaft 88, i.e. the central axis of rotation, whereas the axis of rotation of the auxiliary shaft 96 is laterally offset with respect thereto. The lower end of hollow shaft 102 is rotatably mounted by bearing 103 in the upper bearing wall of rotating frame 91.

In accordance with the above, the drive train for driving the processing chamber assembly 104, which is fastened at the upper end of hollow shaft 102, extends from pulley 83 via drive belt 85, pulley 87, second drive shaft 88, pulley 93, drive belt 94, pulley 95, auxiliary shaft 96, pulley 99, drive belt 100, pulley 101 and hollow shaft 102 to the processing chamber assembly 104.

In the above case, the diameters of pairs of pulleys 83 and 87, of pulleys 93 and 101 as well as of pulleys 95 and 99 are each equal. Thus, driving shaft 81 and hollow shaft 102 are rotating with the same angular velocity. With this drive train it is also possible to introduce flexible tube 105—as also shown in FIG. 1 and discussed with respect thereto—from below through the hollow shaft 102 and to connect it with the processing chamber assembly 104. This means, if considered as a whole, that the drive train for driving the processing chamber assembly 104 essentially corresponds to the one of embodiment according to FIG. 1. Only drive belt 99 and accordingly drive belt 101 are located above the rotating frame 91. On the other hand, the arrangment of the drive pulleys 99 and 101 would also be possible within the rotating frame 91, as this is shown in FIG. 1.

In the embodiment of FIG. 3, a first drive shaft 106 for driving rotating frame 91 is laterally offset with respect to the second drive shaft 88, i.e. is not in the central rotational axis of the entire apparatus. The offset first drive shaft 106 penetrates through the supporting structure 80 and is mounted and positioned there by means of a bearing 107. Underneath the supporting structure 80, the drive pulley 86 is fitted to first drive shaft 106 and connected to driving shaft 81 via drive belt 84 and pulley 82. Preferably, the drive pulleys 82 and 86 have equal diameters so that driving shaft 81 and first drive shaft 106 rotate with equal rotational speeds.

Above the supporting structure 80, the first drive shaft 106 has keyed thereon, at its other end, a further drive pulley 108. Pulley 108 is positioned below rotating frame 91 out of contact therewith. Pulley 108 is, via a drive belt 109, drivingly connected to a pulley 110 whose axis coincides with the central rotational axis of the entire apparatus. Pulley 110 is fixed to the bottom side of rotating frame 91 and has an opening 111 being penetrated by second drive shaft 88. Thus pulley 110 is not in contact with the second drive shaft 88 of the drive train for driving processing chamber assembly 104. In order to obtain the required driving ratio of 2:1 between the processing chamber assembly 104 and the rotating frame 91, pulley 110 has twice the diameter of pulley 108, with the consequence that rotating frame 91 is rotated at half the rotational speed of the drive motor.

Thus, the driving train for rotation of rotating frame 91 extends from motor driving shaft 81 via pulley 82, drive belt 84, pulley 86, first drive shaft 106, pulley 108, drive belt 109 and pulley 110 to rotating frame 91. In a specific embodiment, which is shown in phantom lines in FIG. 3, a motor drive shaft 104 coincides with one of the first or second drive shafts 88 or 106, respectively, and is shown to coincide with first drive shaft 106 in FIG. 3. Accordingly, pulleys 82, 83 and 86 together with separate motor driving shaft 81 are no longer needed, and, in lieu of pulley 86 a pulley 112 is provided for that corresponds in shape and effect to pulley 83 than omitted. Pulley 112 is drivingly connected with pulley 87 via a correspondingly extended drive belt 113 provided in lieu of shorter drive belt 85.

In order to serve as motor driving shaft 114, and simultaneously as first drive shaft 106 for driving rotating frame 91, first drive shaft 106 shown in FIG. 3 in full lines needs only be extended to allow direct drive by the drive motor, as indicated by arrow M in FIG. 3. Therefore, in the alternative embodiment of FIG. 3 shown in phantom lines there, motor driving shaft 81 with the pulleys 82 and 83 thereon may be effectively omitted.

The embodiment of FIG. 3 is shown there only schematically, but it is to be understood that all constructional details of the elements of the drive train and the related construction may correspond to those shown in more detail in FIG. 1.

In all embodiments shown, belt drives are used as driving connections between rotating shafts. Such belt drives have the advantage of the low noise level and are, therefore, preferable to toothed gears. However, the other basic effects and advantages of the invention are also obtained by using toothed gear drives instead of belt drives, even though in this case the rotational direction is reversed at each meshing engagement. Such reversal of the rotational direction, however, will still lead to the processing chamber assembly and the rotating frame rotating in the same direction at the required ratio of 2:1 if, in accordance to the present invention, separate first and second drive shafts are each connected to the drive motor by individual drive trains, i.e. each drive train for the processing chamber assembly and the rotating frame, respectively, has a motor drive of its own so as to avoid the use of any orbital movement as a source of rotational movement of one of the drive trains by drivingly connecting such orbiting element to some stationary element to produce the rotational movement.

Whether the drive shafts for the processing chamber assembly and the rotating frame, i.e. generally the element guiding the flexible tube loop in its orbital movement, are arranged coaxially or laterally set off against one another, the invention allows for a compact and simple construction also avoiding any seals with relative rotational movement, and a construction wherein also the rotating masses are kept small.

It is to be understood that the driving ratio between the various pulleys and gears described to be 2:1 is normally preferred to obtain the different rotational speeds in the ratio of 2:1 between the processing chamber 4, 70 or 104, respectively, and the loop guide assembly. However, essential is only to have such rotational speed difference between the processing chamber and the loop guide assembly, regardless of the diameter ratios of individual pulleys or gears in the drive train. Therefore, if this should be of advantage in a given case, the pulleys or gears shown to have a diameter ratio of 2:1 may also have a differing diameter ratio of e.g., 1:1 or whatever, including any intermediate values, provided that the difference in rotational speed so obtained as compared to the embodiments described is set off at any other pair of pulleys or gears in the drive train so as to ensure the proper rotational speeds of the processing chamber assembly and the loop guide assembly as explained above.

We claim:

1. A centrifugal apparatus comprising a processing chamber assembly, a flexible cable or tube permanently connected between a stationary terminal and said processing chamber assembly, a loop formed by said cable or tube, said cable or tube being connected to said processing chamber assembly on the side thereof opposite to said stationary terminal, and being guided around the outer periphery of said processing chamber assembly, a drive train for driving said processing chamber assembly at a determined rotational speed, a loop guide assembly for said loop of said cable or tube being capable of revolving, or orbiting, said loop at half the rotational speed and in the same rotational direction as said processing chamber assembly, said processing chamber assembly being rotatably mounted on said loop guide assembly, characterized in that there is provided a first drive shaft for a drive train driving said loop guide assembly, and there is provided a second drive shaft for said drive train driving said processing chamber assembly, said first and second drive shafts each being drivingly connected to a driving shaft of a motor drive unit mounted on a stationary supporting structure.

2. The centrifugal apparatus of claim 1, wherein said first drive shaft is a hollow shaft, said second drive shaft extending through the interior opening thereof

3. The centrifugal apparatus of claim 2, wherein said hollow shaft is rotatably mounted in said supported structure, and said second drive shaft is rotatably mounted in the interior opening of said hollow shaft.

4. The centrifugal apparatus of claims 2 or 3, wherein said hollow shaft is mounted in a stationary bearing shell, said bearing shell being removably fastened to said supporting structure.

5. The centrifugal apparatus of claim 1 or 2, wherein drive belts and pulleys are used for establishing the rotational driving connections, the pulleys on said motor driving shaft having equal diameters.

6. The centrifugal apparatus of claim 5 when depending on claim 2, wherein the pulley on said hollow shaft and the pulley on said second drive shaft have a diameter ratio of 2:1.

7. The centrifugal apparatus of claim 5 when depending on claim 1, wherein the pulley of said loop guide assembly and the pulley on said first drive shaft for driving said loop guide assembly have a diameter ratio of 2:1.

8. The centrifugal apparatus of claim 1, wherein said loop guide assembly comprises a rotating frame having upper and lower bearing plates and bracings therebetween.

9. The centrifugal apparatus of claim 8, wherein said upper and lower bearing plates serve for mounting an auxiliary shaft having an axis in parallel to the axes of said first and second driving shafts and being journaled in bearings positioned in said upper and lower bearing plates, said auxiliary shaft having keyed thereon two laterally spaced apart pulleys, one of said pulleys being via a drive belt drivingly connected to a pulley on said second drive shaft, and the other of said pulleys being via a drive belt drivingly connected to a pulley securely connected to said processing chamber assembly, thus providing free space around the central axis of the apparatus allowing positioning of the cable or tube there at a location between said processing chamber assembly and said second drive shaft.

10. The centrifugal apparatus of claim 9, wherein said bearings for said auxiliary shaft are kept accessible from the radially outward side of said rotating frame, and are removably fastened to said upper and lower bearing plates.

11. The centrifugal apparatus of claim 9, wherein said processing chamber assembly is fitted to a hollow shaft, said hollow shaft being rotatably mounted in a bearing shell removably fastened to said upper bearing plate.

12. The centrifugal apparatus of claim 8, wherein said processing chamber assembly is located above said lower bearing plate and above or below said upper bearing plate.

13. The centrifugal apparatus of claim 1, wherein said loop guide assembly comprises a loop guide member having, at a location laterally offset with respect to the central axis of the apparatus, a guide ring embracing said cable or tube.

14. The centrifugal apparatus of claim 13, wherein said guide ring comprises a snap lock for opening said guide ring in order to allow for insertion and removal of said cable or tube into or from said guide ring, respectively.

15. The centrifugal apparatus of claim 1, wherein said second drive shaft for driving said processing chamber assembly is coaxial to the central axis of the apparatus, and said first drive shaft for driving said loop guide assembly is located laterally offset and in parallel to said second drive shaft.

16. The centrifugal apparatus of claim 7, 8 and 15, wherein said first drive shaft is rotatably mounted in said supporting structure and has, above said supporting structure, keyed thereto a pulley, said pulley being via a drive belt drivingly connected with said pulley secured to said loop guide assembly, said latter pulley being fastened to the bottem side of said lower bearing plate of said rotating frame.

17. The centrifugal apparatus of claim 1, wherein said motor driving shaft is arranged coaxially to one of said first and second drive shafts, and is keyed thereto or unitary therewith.

* * * * *